US010731592B2

(12) United States Patent
Chia et al.

(10) Patent No.: US 10,731,592 B2
(45) Date of Patent: Aug. 4, 2020

(54) ADJUSTING AN ATTENUATION CURRENT OF AN INJECTION VALVE OF A HIGH PRESSURE INJECTION SYSTEM

(71) Applicant: CPT Group GmbH, Hannover (DE)

(72) Inventors: Tet Kong Brian Chia, Regensburg (DE); Dmitriy Kogan, Roding (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 16/340,182

(22) PCT Filed: Sep. 7, 2017

(86) PCT No.: PCT/EP2017/072528
§ 371 (c)(1),
(2) Date: Apr. 8, 2019

(87) PCT Pub. No.: WO2018/068960
PCT Pub. Date: Apr. 19, 2018

(65) Prior Publication Data

US 2019/0309700 A1 Oct. 10, 2019

(30) Foreign Application Priority Data

Oct. 13, 2016 (DE) ..... 10 2016 219 956

(51) Int. Cl.
*F02M 59/46* (2006.01)
*F02D 41/38* (2006.01)
(Continued)

(52) U.S. Cl.
CPC ..... *F02D 41/38* (2013.01); *F02D 41/20* (2013.01); *F02D 41/2451* (2013.01);
(Continued)

(58) Field of Classification Search
CPC ..... F02D 41/38; F02D 41/20; F02D 41/2451; F02D 41/3845; F02D 41/3082;
(Continued)

(56) References Cited

U.S. PATENT DOCUMENTS 9,926,878 B2 * 3/2018 Suzuki ..... F02D 41/3082
2004/0000289 A1 * 1/2004 Seo ..... F02M 59/022 123/447
(Continued)

FOREIGN PATENT DOCUMENTS

CN 102465765 A 5/2012 ..... F02D 1/00
DE 10 2011 085 277 A1 5/2013 ..... F02D 41/20
(Continued)

OTHER PUBLICATIONS

German Office Action, Application No. 10 2016 219 956.0, 5 pages, dated Mar. 28, 2017.
International Search Report and Written Opinion, Application No. PCT/EP2017/072528, 22 pages, dated Dec. 20, 2017.

*Primary Examiner* — Thomas N Moulis
(74) *Attorney, Agent, or Firm* — Slayden Grubert Beard PLLC

(57) ABSTRACT

Various embodiments include a method for adjusting an initial attenuation current for an injection valve comprising: moving a piston to a TDC; while moving the piston, closing an inlet valve; expelling the fluid; moving the piston away from TDC and applying an attenuation current to an electromagnet with the inlet valve still closed; switching a source for the attenuation current off; detecting an induction pulse resulting from an opening movement of the inlet valve by monitoring a current intensity signal of a subsequent decay in the current; adjusting a current intensity over a plurality of pump cycles to a current intensity level; checking for each current intensity level whether a time profile of the induction pulse satisfies a predetermined detention cri-
(Continued)

terion; and when the detention criterion is satisfied, adjusting the current intensity level for future pump cycles to a lower current intensity level than the most recent level.

9 Claims, 6 Drawing Sheets

(51) Int. Cl.
*F02D 41/20* (2006.01)
*F02D 41/24* (2006.01)
*F02M 59/36* (2006.01)
*F02D 41/30* (2006.01)

(52) U.S. Cl.
CPC ..... *F02D 41/3845* (2013.01); *F02M 59/368* (2013.01); *F02D 41/3082* (2013.01); *F02D 2041/2037* (2013.01); *F02D 2041/2055* (2013.01); *F02D 2041/2058* (2013.01); *F02M 59/466* (2013.01)

(58) Field of Classification Search
CPC ..... F02D 2041/2037; F02D 2041/2055; F02D 2041/2058; F02D 41/406; F02M 59/368; F02M 59/466; F02M 59/46; F02M 59/446
See application file for complete search history.

(56) References Cited

U.S. PATENT DOCUMENTS

| | | | | |
|---|---|---|---|---|
| 2008/0216797 | A1* | 9/2008 | Oono | F02D 41/062 123/447 |
| 2011/0288748 | A1* | 11/2011 | Richter | F02D 41/20 701/103 |
| 2012/0118271 | A1 | 5/2012 | Borg et al. | 123/495 |
| 2012/0255636 | A1* | 10/2012 | Mancini | F02M 59/366 137/565.16 |
| 2013/0226488 | A1* | 8/2013 | Wirkowski | F02M 59/466 702/64 |
| 2015/0136090 | A1 | 5/2015 | Maess et al. | 123/482 |
| 2016/0025030 | A1 | 1/2016 | Ulrey et al. | 123/294 |
| 2016/0237937 | A1 | 8/2016 | Kusakabe et al. | 123/490 |
| 2017/0292468 | A1* | 10/2017 | Lee | F02D 41/3005 |
| 2017/0342935 | A1 | 11/2017 | Arihara et al. | |
| 2018/0328308 | A1* | 11/2018 | Iwano | F02M 59/466 |

FOREIGN PATENT DOCUMENTS

| | | | | |
|---|---|---|---|---|
| DE | 10 2012 208 614 | A1 | 11/2013 | F02D 41/20 |
| DE | 10 2014 220 975 | A1 | 4/2016 | F02M 59/46 |
| JP | 2007-231929 | A | 9/2007 | F02D 41/04 |
| JP | 2015-063928 | A | 4/2015 | F02D 41/20 |
| WO | 2016/117400 | A1 | 7/2016 | F02M 51/04 |
| WO | 2018/068960 | A1 | 4/2018 | F02D 41/20 |

* cited by examiner

ADJUSTING AN ATTENUATION CURRENT OF AN INJECTION VALVE OF A HIGH PRESSURE INJECTION SYSTEM

CROSS-REFERENCE TO RELATED APPLICATIONS

This application is a U.S. National Stage Application of International Application No. PCT/EP2017/072528 filed Sep. 7, 2017, which designates the United States of America, and claims priority to DE Application No. 10 2016 219 956.0 filed Oct. 13, 2016, the contents of which are hereby incorporated by reference in their entirety.

TECHNICAL FIELD

The present disclosure relates to motor vehicles. Some embodiments of the teachings herein include methods and/or systems for adjusting an attenuation current in a high-pressure pump of a high-pressure injection system of an internal combustion engine in a motor vehicle, including braking an opening movement of an inlet valve of the high-pressure pump by means of the attenuation current in order to reduce opening noise.

BACKGROUND

In a motor vehicle, a fuel for an internal combustion engine can be conveyed or pumped by means of a high-pressure injection system. A high-pressure injection system of this kind has a high-pressure pump which can convey the fuel toward the internal combustion engine on a high-pressure side with a pressure of greater than 200 bar. The fuel pump can have a piston which is moved back and forth between a bottom dead center and a top dead center in a compression chamber or swept volume. To this end, the piston can be driven, for example, by a motor shaft of the internal combustion engine. A complete cyclical movement of the piston is referred to as the pump cycle here.

As part of the piston movement from the top dead center to the bottom dead center, an opening movement of an inlet valve of the high-pressure pump begins, in each pump cycle, starting from a specific opening position of the piston. This is then the beginning of an intake phase in which fuel or, in general, a fluid flows into the compression chamber through the inlet valve. After the bottom dead center is reached, the intake phase ends and the piston is moved back toward the top dead center. During this expulsion phase, the fluid is expelled from the compression chamber again by the movement of the piston toward the top dead center. Provided that the inlet valve is open in this case, the fluid flows back to a low-pressure side through the inlet valve. Therefore, the inlet valve is closed by a control device by current being applied to an electromagnet during the movement of the piston toward the top dead center. The electromagnet to which current is applied magnetically attracts an armature which is connected to the inlet valve, so that said valve is carried along. When the inlet valve is closed, the fluid is no longer expelled through the inlet valve, but rather through an outlet valve, owing to the piston movement. The outlet valve may be, for example, a non-return valve. The fluid which is expelled through the outlet valve generates the fluid pressure on the high-pressure side downstream of the outlet valve.

The described opening movement of the inlet valve from the closed position to the open position creates the problem that the inlet valve stops when it reaches the (completely) open position and as a result generates undesired noise. In order to counter this generation of noise, a restraining current can flow through or be applied to the electromagnet during the opening movement in order to brake the opening movement by way of the magnetic force generated as a result, so that the inlet valve stops more gently or at a lower speed in the opening position.

Since the inlet valve moves away from the electromagnet during the opening movement, the restraining current of said electromagnet is continuously increased in order to exert a constant braking force on the inlet valve. The critical factor here is the starting current which has to flow while the inlet valve is released from the closed position. Here, this starting current is called the initial attenuation current, or attenuation current for short. If the current intensity of the attenuation current is too high, an excessively high restraining force is exerted on the inlet valve by the electromagnet, as a result of which it does not open at all or opens too late, this in turn having an adverse effect on the intake phase and therefore the efficiency of the high-pressure pump. If the attenuation current is too weak, the inlet valve can be released from the closed position with too much momentum or with too much acceleration, so that the restraining current which then flows no longer provides sufficient braking for effectively attenuating the noise.

SUMMARY

The teachings herein describe various methods and/or systems for adjusting a current intensity of an attenuation current which has to flow at the beginning of an opening movement of an injection valve of a high-pressure pump in order to provide noise attenuation. For example, some embodiments include a method for adjusting an initial attenuation current (44) for braking an injection valve (16) in a high-pressure pump (15) of a high-pressure injection system (13) in a motor vehicle (10), wherein, in a compression chamber (33) of the high-pressure pump (15), a piston (22) is moved in successive pump cycles (C) to a top dead center (31) in each case and as a result a fluid (14) which is arranged in the compression chamber (33) is expelled from the compression chamber (33) and, in the process, the inlet valve (16) is closed by a control device (17) by current being applied to an electromagnet (18) and as a result the fluid (14) is expelled by the piston (22) through an outlet valve (26), characterized in that, while the piston (22) is then moved away from the top dead center (31), the attenuation current (44) is applied to the electromagnet (18) by the control device (17), with the inlet valve (16) still closed, and a source for the attenuation current (44) is then switched off again and an induction pulse (47), which is caused by an opening movement of the inlet valve (16), is detected in a current intensity signal (46) of the subsequently decaying attenuation current (44), and a current intensity value (45) of the attenuation current (44) is adjusted over a plurality of pump cycles (C) to a current intensity level (54) in each case for one or some of the pump cycles (C) and then a changeover is made to a next current intensity level (54) and a check is made for each current intensity level (54) in respect of whether a time profile of the induction pulse (47) satisfies a predetermined detention criterion and, when the detention criterion is satisfied, the current intensity level (45) for future pump cycles (C) is adjusted to a lower current intensity level (54) than that by which the detention criterion is satisfied.

In some embodiments, each current intensity level (54) provides a higher current intensity value (45) than the preceding current intensity level (54) and, when the detention criterion is satisfied, the current intensity value (45) of the preceding current intensity level (54) is set for the future pump cycles (C).

In some embodiments, after the source of the attenuation current (44) is switched off, a first inflection point (48) and a second inflection point (49) are detected as induction pulse (47) in the dropping current intensity signal (46) of the attenuation current (44).

In some embodiments, a difference value (D) of a respective value (51) of the current intensity signal (46) is recorded at the second inflection point (49) and at the first inflection point (48). In some embodiments, the difference value (D) of the induction pulse (47) is ascertained for each current intensity level (54) and comprises the detention criterion that a relative change in the difference value (D) in the event of a change from one current intensity level (54) to the next higher current intensity level (54) is greater than a predetermined threshold value (56).

In some embodiments, a time period (50) which elapses between the first inflection point (48) and the second inflection point (49) is recorded and wherein the detention criterion comprises the time period (50) being greater than a predetermined maximum value.

In some embodiments, the source of the attenuation current (44) comprises a current intensity regulator and the current intensity level (45) is set as a setpoint value in the current intensity regulator.

As another example, some embodiments include a control device (17) for a high-pressure injection system (13) of an internal combustion engine (11) of a motor vehicle (10), characterized in that the control device (17) is designed to implement a method as described above.

As another example, some embodiments include a control high-pressure injection system (13) for a motor vehicle (10), having a high-pressure pump (15), characterized in that the high-pressure injection system (13) has a control device (17) as described above.

As another example, some embodiments include a motor vehicle (10) comprising an internal combustion engine (11) and a high-pressure injection system (13) as described above.

BRIEF DESCRIPTION OF THE DRAWINGS

An exemplary embodiment of the teachings herein is described below. To that end, in the figures.

DETAILED DESCRIPTION

Figure 1:
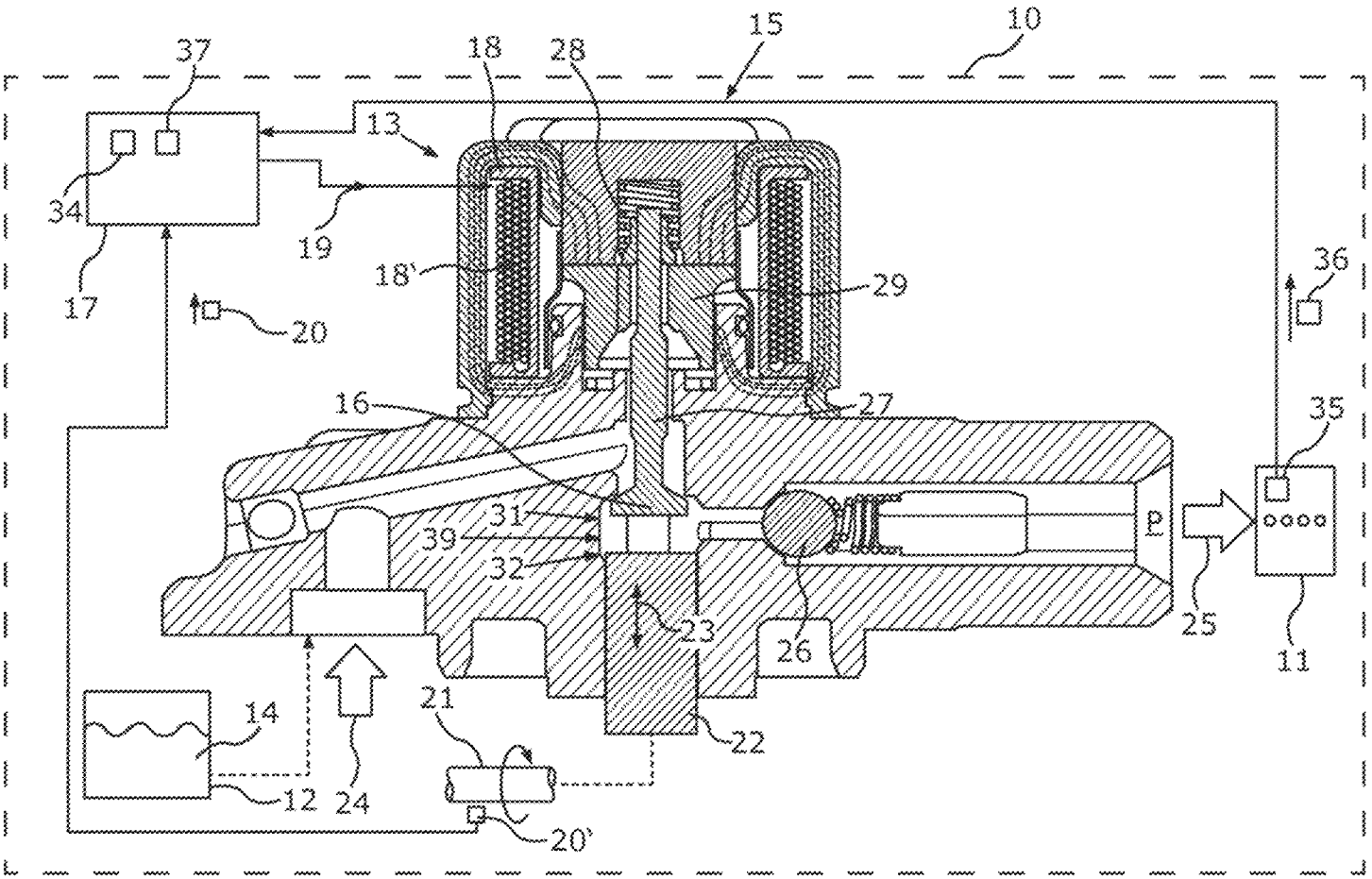
FIG. 1 shows a schematic illustration of an embodiment of the motor vehicle incorporating teachings of the present disclosure.

In some embodiments, a method for operating a high-pressure injection system starts at the point after the inlet valve has been closed by the control device in order to redirect the fluid through the outlet valve. After the inlet valve is closed, the current can normally be switched off again by the electromagnet since enough pressure builds up in the compression chamber in order to keep the inlet valve closed. In this case, the pressure is also then high enough when the piston, after reaching the top dead center, is moved away from said top dead center again and toward the bottom dead center. This is due to the fact that, in the compression chamber, the remaining fluid or fluid still present is elastically compressed while the piston is at the top dead center. If the piston moves away from the top dead center, the fluid initially expands, but it still exerts a sufficiently high pressure on the inlet valve in order to keep said inlet valve closed. The opening movement of the inlet valve therefore begins only when the piston has already moved away from the top dead center and has reached said opening position which is specifically distinguished in that the pressure in the compression chamber has become lower than a pressure force which is exerted on the inlet valve by a valve spring of the high-pressure pump and by the fluid of the low-pressure side which is located upstream on the other side of the inlet valve.

In some embodiments, a measurement current is now nevertheless applied to or flows through the electromagnet owing to the control device with the inlet valve closed, even though this is not necessary for keeping the inlet valve closed. In the process, an attenuation current, the current intensity of which is varied, is experimentally applied to the electromagnet by the control device. The actual restraining current can remain switched off in the process. Therefore, as the piston is moved away from the top dead center, an attenuation current is applied to the electromagnet by the control device with the inlet valve still closed. To this end, the control device can actuate a source for the attenuation current in a known manner. The source is then switched off again. In the case of a sufficiently low attenuation current, the inlet valve can have opened in the meantime. In the case of an excessively high attenuation current, the inlet valve was kept closed by the electromagnet against the spring force of the valve spring.

However, switching off the attenuation current does not lead to the attenuation current instantly dropping to 0 in the electromagnet. Rather, the attenuation current gradually decays, for example with an exponential profile, on account of the inductance of the coil of the electromagnet. An induction pulse which is produced when the inlet valve is moved out of the closed position to the open position is detected in the resulting current intensity signal of the decaying attenuation current. Therefore, the induction pulse is caused by the opening movement. The shape of the induction pulse provides information about the extent to which the inlet valve has been held back by the adjusted attenuation current. This information is used by way of the described measurement being repeated over several pump cycles and, in the process, the current intensity value of the attenuation current being adjusted to a specific current intensity level in each case. This current intensity level is maintained for one or for a few of the pump cycles.

A changeover is then made to the next current intensity level and the induction pulse is respectively again ascertained for one or for a few pump cycles. A check is made for each current intensity level in respect of whether a time profile of the induction pulse satisfies a predetermined detention criterion. The detention criterion describes a shape of the induction pulse which is produced when the current intensity level was too high, that is to say the inlet valve was not only braked by the attenuation current but rather was held back, that is to say was held closed in an undesirable manner. This effect is called the detention effect here. If the detention criterion is satisfied, that is to say when the current intensity of the attenuation current was too high, the current intensity value for future pump cycles is adjusted to a lower current intensity level than that by which the detention criterion is satisfied, that is to say the detention effect occurs.

Therefore, this current intensity level then constitutes the current intensity for the starting current starting from which the opening movement for the described braking of the opening movement is implemented. The described method for detecting the induction pulse therefore does not make provision for the opening movement to actually be braked during the implementation. It is merely a matter of correctly adjusting the starting current intensity, that is to say the initial attenuation current intensity, in accordance with the detention criterion. The actual method for attenuating the opening movement is only then applied by operating the electromagnet during the entire opening movement.

In some embodiments, for the purpose of saving time when ascertaining the suitable current intensity level each current intensity level may have a higher current intensity value than the preceding current intensity level. The current intensity is therefore increased in steps. When the detention criterion is satisfied, the current intensity value of the preceding current intensity level is set for the future pump cycles. Therefore, the suitable current intensity value is found by simply switching back the current intensity level.

In some embodiments, in order to detect the induction pulse, after the source of the attenuation current is switched off, that is to say when the attenuation current drops or decays, the method includes detecting a first inflection point toward a renewed increase in current and a second inflection point back to the drop in current in the dropping current intensity signal. Therefore, a temporary increase in current is detected as an induction peak in a dropping current intensity signal. By detecting the inflection point, a difference value of a respective amplitude value of the current intensity signal can advantageously be recorded at the second inflection point and at the first inflection point. The induction gradient, that is to say the change in current intensity, can be ascertained from this. The difference value constitutes a pulse height. This is a measure of the kinetic energy of the inlet valve, so that the braking effect or the restraining force of the attenuation current is quantified or evaluated.

In some embodiments, to identify the changeover from a desired braking effect to the undesired detention effect, that is to say a situation of the inlet valve unnecessarily being kept closed, the method includes ascertaining the difference value of the induction pulse (that is to say the pulse height) for each current intensity level and to comprise the detention criterion that a relative change in the difference value in the event of a change from one current intensity level to the next higher current intensity level is greater than a predetermined threshold value. This embodiment is based on the finding that there is an increase in the difference value by more than a predeterminable threshold value if the attenuation current is such that the inlet valve is held back by said attenuation current (detention effect).

In some embodiments, a time period which elapses between the first inflection point and the second inflection point can likewise be recorded. This time period is a measure of the movement period of the inlet valve from the closed position until the open position is reached. The detention criterion can then comprise the situation that this time period is greater than a predetermined maximum value. This then indicates that the inlet valve has been kept in the closed position by the attenuation current and the inlet valve was able to move from said closed position only too late and only slowly.

In order to be able to adjust the attenuation current in a targeted manner, some embodiments include setting a current intensity regulator to be provided as said source of the attenuation current and for the current intensity level as a setpoint value in the current intensity regulator. Said current intensity regulator may be, for example, a two-point regulator.

In some embodiments, a control device for a high-pressure injection system of an internal combustion engine of a motor vehicle is configured for implementing the methods described herein. The control device is designed to implement the described method steps. Equipping a high-pressure injection system with the control device incorporating the teachings herein produces an embodiment of the high-pressure injection system. Furthermore, the high-pressure injection system incorporating the teachings herein has a high-pressure pump. In some embodiments, there is a motor vehicle which has the described internal combustion engine and an embodiment of the high-pressure injection system described herein.

In the figures, the described components of the embodiment each constitute individual features which should be considered independently of one another and which in each case also develop the teachings herein independently of one another and should therefore also be regarded as a constituent part individually or in a different combination to that shown. Furthermore, the embodiment described can also be supplemented by further features of the invention from among those that have already been described. In the figures, functionally identical elements are provided with the same reference signs in each case.

FIG. 1 shows a motor vehicle 10, which may be, for example, an automobile, such as a passenger car or truck for example. The motor vehicle 10 can have an internal combustion engine 11 which can be coupled to a fuel tank 12 by means of a high-pressure injection system 13. A fluid 14 which is contained in the fuel tank 12, that is to say a fuel for example, such as diesel or petrol for example, can be conveyed to the internal combustion engine 11 by means of the high-pressure injection system 13. To this end, the high-pressure injection system 13 can have a high-pressure pump 15 comprising an inlet valve 16 and a control device 17 for controlling an electromagnet 18 of the inlet valve 16.

The control device 17 can adjust a coil current 19 which flows through an electrical coil 18' of the electromagnet 18. The control device 17 can adjust the coil current 19 depending on a rotation position signal 20 of a rotation position transmitter 20', which rotation position signal describes or indicates a rotation position of a motor shaft 21 of the motor vehicle 10. The motor shaft 21 can be coupled, for example, to a crankshaft of the internal combustion engine 11. The motor shaft 21 may also be the crankshaft itself. A piston 22 of the high-pressure pump 15 is also driven by the motor shaft 21 to perform a piston movement 23 in a compression chamber 33. The piston movement 23 moves the piston back and forth between a top dead center 31 and a bottom dead center 32 in pump cycles. The fluid 14 is conveyed from a low-pressure side 24 of the high-pressure pump 15 to a high-pressure side 25 by the piston movement 23 of the piston 22. In the process, the fluid 14 flows through the inlet valve 16 and an outlet valve 26.

In the process, a pin 27 of the inlet valve 16 is moved by means of the coil current 19 by current being applied to the coil 18' of the electromagnet 18. In this case, a valve spring 28 counteracts the magnetic force of the electromagnet 18 and in this way pushes the pin 27 toward an open position, as is shown in FIG. 1. By virtue of adjusting the coil current 19, the spring force of the valve spring 28 is overcome and an armature 29 with the pin 27 fastened to it is moved counter to the spring force of the valve spring 28 and the inlet valve 16 is closed in this way.

The respective time at which the control device 17 closes the inlet valve 16 by applying current to the electromagnet 18 in each pump cycle is defined by a regulator 34 of the control device 17, which regulator can receive a sensor signal 36 from a pressure sensor 35, which sensor signal indicates a current fluid pressure of the fluid in a part of the high-pressure injection system 13 which is positioned downstream of the outlet valve 16. Therefore, a fluid pressure P of the high-pressure side 25 is indicated by the pressure sensor 35 and the control device 17 can regulate the fluid pressure P at a setpoint value 37 by adjusting the time for closing the inlet valve 16. However, this assumes that the sensor signal 36 actually corresponds to the fluid pressure P.

Figure 2:
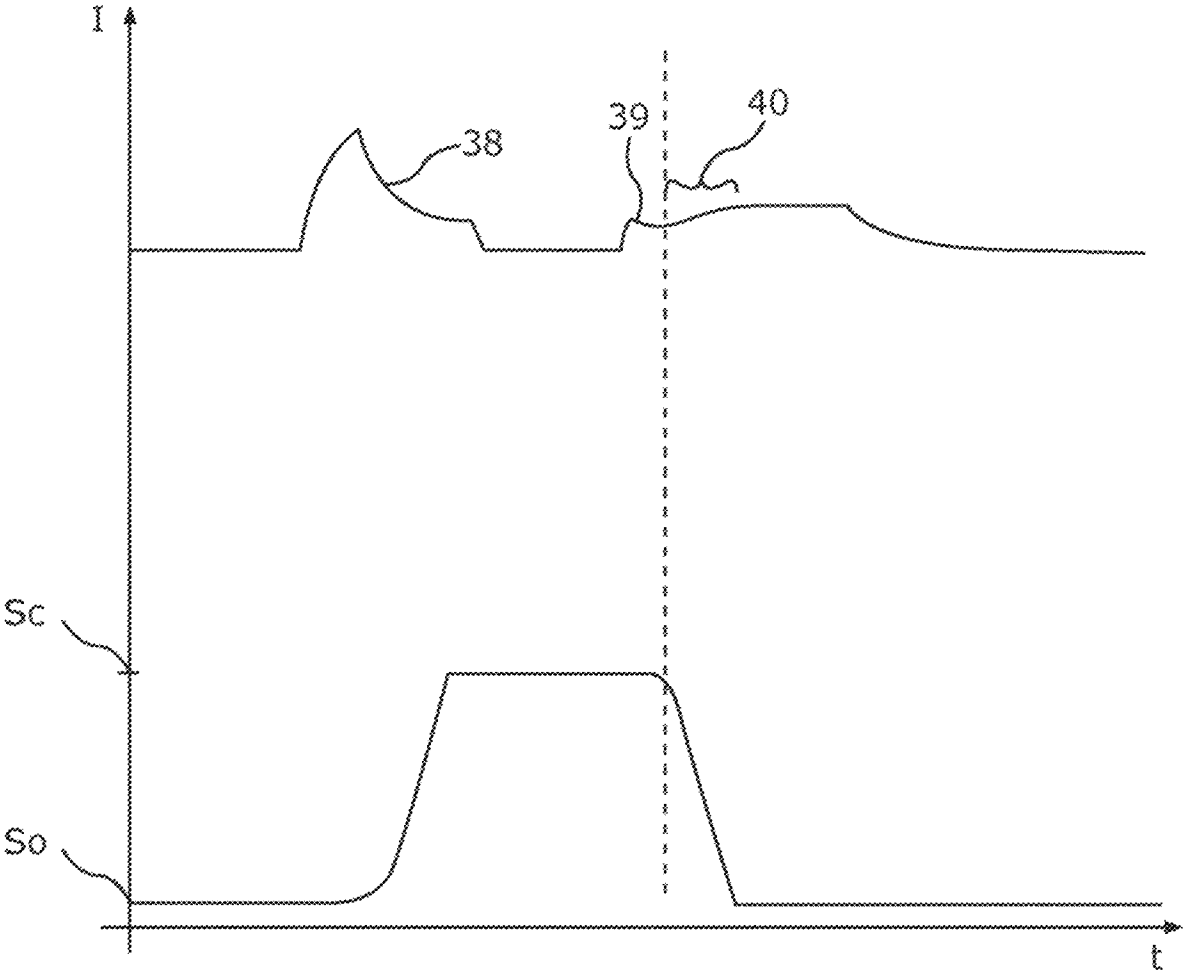
FIG. 2 shows graphs with schematic profiles of a current intensity signal of an electrical coil of a high-pressure pump of the motor vehicle from FIG. 1.

FIG. 2 shows a profile of the current intensity I of the coil current 19 with respect to time t and the resulting position of the inlet valve 16, wherein a closed position Sc and an open position So are identified. The inlet valve 16 is closed by adjusting a closing current 38 during the intake phase. While the piston 22 is then later moved away from the top dead center 31 in the pump cycle, a restraining current 39 can be set as the coil current 19 in order to brake the inlet valve 16, said restraining current not preventing the inlet valve 16 from opening automatically, however. This automatic opening will be explained in more detail below with reference to FIG. 3.

After the inlet valve has moved out of the closed position Sc, it accelerates, specifically in the direction of the open position So. This acceleration is braked by the restraining current 39. Owing to an increase 40 in the restraining current 39, said restraining current is also still present when the inlet valve 16 has already moved out of the closed position Sc, so that the gentle or curved changeover shown or the acceleration of the inlet valve 16 starting from the closed position Sc toward the open position So is produced. The acceleration of the inlet valve 16 on the way from the closed position Sc as far as the open position So is therefore lower and the impact speed or contact speed of the inlet valve 16 when reaching the open position So is lower overall than without the restraining current 39. This prevents or reduces the operating noise of the inlet valve 16 in the high-pressure pump 15.

In order to set the restraining current 39 to be low enough at the beginning of the opening movement that the inlet valve 16 is not stuck or does not permanently remain in the closed position Sc, said restraining current is calibrated individually for the high-pressure pump 15. To this end, the control device 17 can have a microprocessor or a microcontroller.

Figure 3:
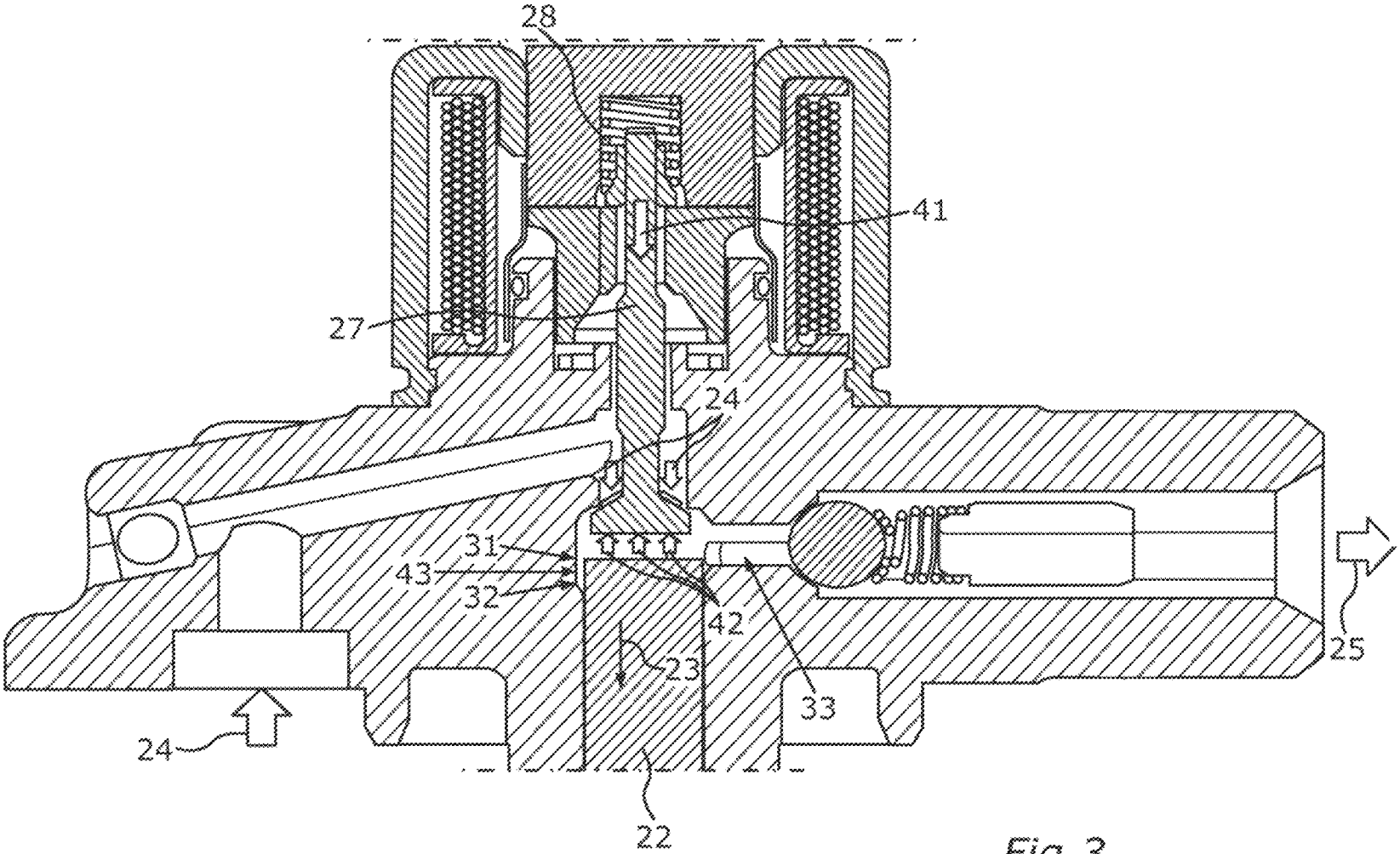
FIG. 3 shows a schematic illustration of a high-pressure pump of the motor vehicle from FIG. 1.

In connection with FIG. 3, the detachment process, that is to say the release of the inlet valve 16 from the closed position Sc, will once again be described for further explanation of said self-calibration. FIG. 3 illustrates the basic measurement principle. To this end, FIG. 3 shows how the pin 27 is held in the illustrated closed position of the inlet valve 16 even when there is no coil current 19 flowing. The reason for this is that the low pressure 24 together with a spring force 41 of the valve spring 28 is lower than a pressure force 42 of the compressed fluid 14 in the compression chamber 33 even after overshooting of the top dead center 31. The piston 22 first has to reach a predetermined opening position 43 between the top dead center 31 and the bottom dead center 32, so that the fluid 14 in the compression chamber 33 is expanded to a sufficient extent that the pressure in the compression chamber 33 produces a pressure force 42 which is low enough to move the pin 27 from the closed position, shown in FIG. 3, toward the open position, shown in FIG. 1, by means of the spring force 41 and the low pressure 24.

Figure 4:
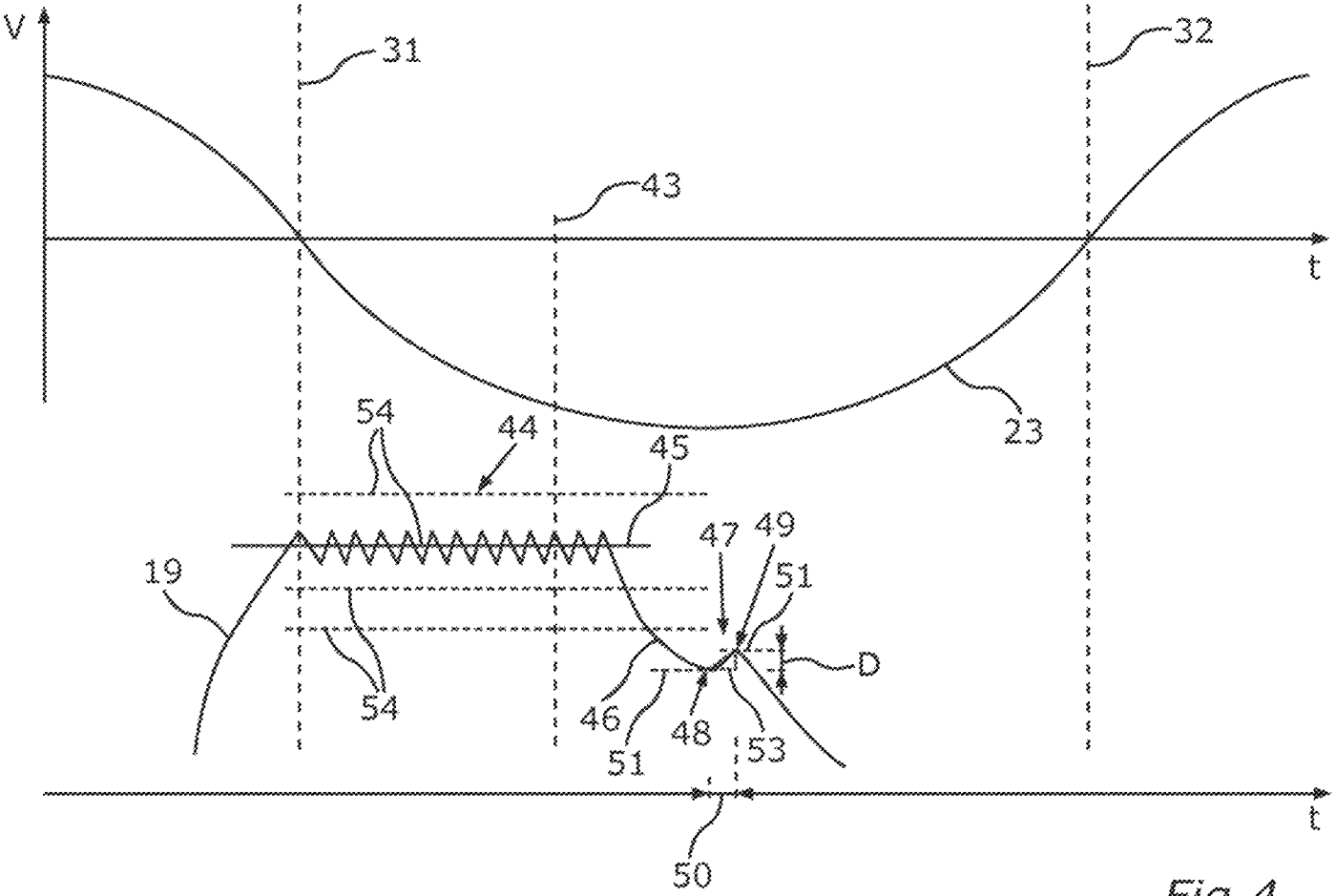
FIG. 4 shows graphs with schematic profiles of signals as can be ascertained by a control device in the motor vehicle from FIG. 1.

FIG. 4 shows how the degree of attenuation or the braking effect which can be exerted on the opening movement of the inlet valve 16, that is to say the pin 27 of said inlet valve, by means of the electromagnet 18 by adjusting a coil current 19 can be ascertained by the control device 17. Here, FIG. 4 illustrates, with respect to time t, firstly the movement speed V of the piston 22 during the valve movement 23 and a time profile of the coil current 19. The coil current 19, with the inlet valve 16 still closed, can be connected or adjusted to an attenuation current 44 with a setpoint value 45, for example by means of a two-point regulator (not illustrated) as source, by the control device 17.

If the current intensity of the attenuation current 44, that is to say the setpoint value 45, is low enough, the inlet valve 16 can nevertheless begin the opening movement, that is to say the opening position 43 of the piston 22 lies in a time range during which the attenuation current 44 is still flowing. Otherwise, said opening position lies in a time range after the attenuation current 44 is switched off. In order to find this out, the attenuation current 44 is switched off again by the control device 17, even before the inlet valve reaches the open position Sc. This results in a current intensity signal 46 dropping toward zero. To this end, the switching time can be estimated by way of the open position 43 first being ascertained without the attenuation current 44. The induction pulse 47 described below also provides information about a suitable switch-off time.

Owing to the opening movement of the inlet valve 16 toward the open position So, an induction current is induced in the electrical coil 18', which induction current can be measured by the control device 17 as the induction pulse 47 in the dropping current intensity signal 46. A first inflection point 48 and a second infection point 49 in the current profile 46 can be detected by the control device 17. Furthermore, a time period 50 which elapses between the two inflection points 48, 49 can be identified. A difference value D which describes the pulse height of the induction pulse 47 can be calculated from the respective current intensity value 51 which the current intensity signal 46 exhibits at the two inflection points 48, 49. Therefore, an induction gradient 53 can be ascertained by the control device 17 on the basis of the time period 50 and the difference value D.

The induction gradient 53 describes the speed of the opening movement of the inlet valve 16 from the top dead center Sc as far as the bottom dead center So. The faster the inlet valve 16 is moving, that is to say the smaller the braking effect by the attenuation current 44 was, the greater or steeper the gradient 53. It is important here that the braking effect is at the minimum and therefore the gradient 53 is at the maximum if the attenuation current 44 was so high that the detention force has occurred. This is because the inlet valve 16 then remains closed until the attenuation current 44 is switched off and is then accelerated at the maximum by the valve spring 28 without the braking effect of the attenuation current. A sudden increase in the gradient 53 therefore indicates the changeover from the braking effect (beginning of the opening movement as early as during the attenuation current) to the detention effect (beginning of the opening movement only after the attenuation current is switched off). Setting different current intensity levels 54, that is to say different setpoint values 45, renders it possible to measure which current intensity level 54 should be used as the initial attenuation current 39 for the braking method described in FIG. 2 in order to obtain the maximum braking effect without the detention effect.

Figure 5:
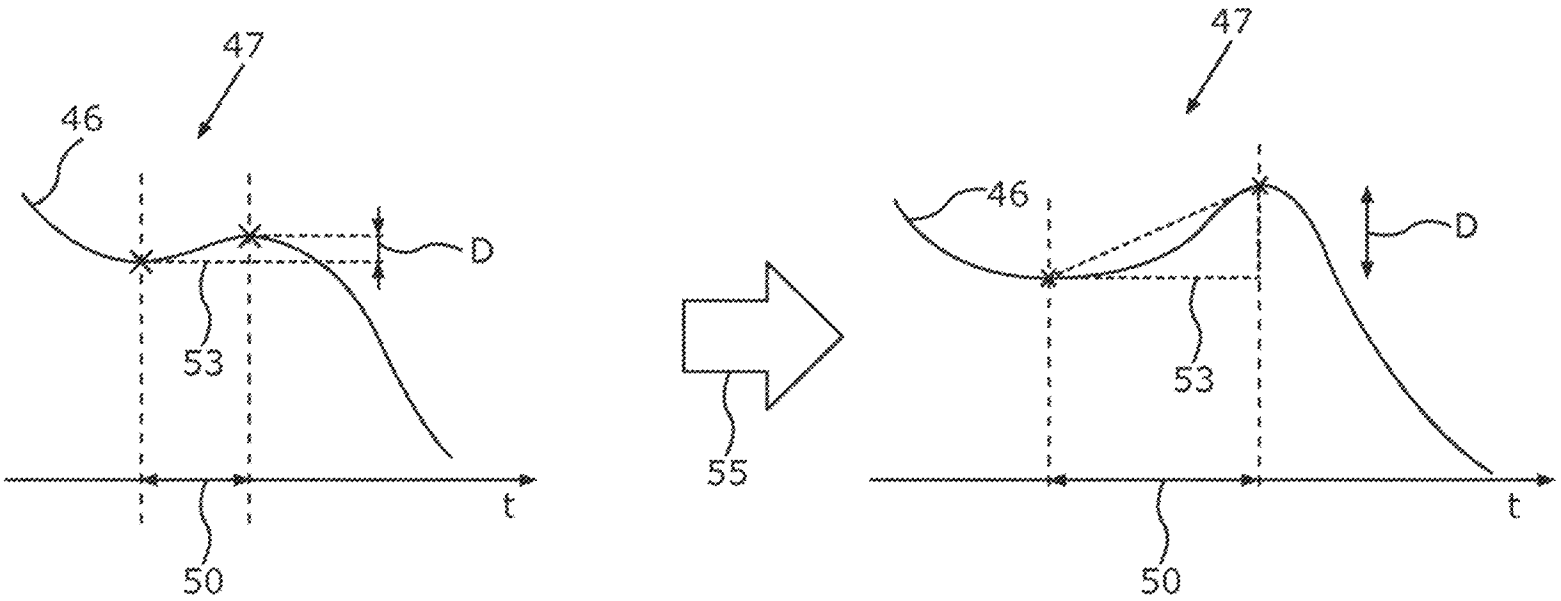
FIG. 5 shows graphs with schematic profiles of induction pulses at different current intensity values of an attenuation current.

To this end, FIG. 5 illustrates a gradient 53 of the induction pulse 47 which is produced for two different current intensity levels. A smaller or lower current intensity level 54 is set for the current intensity signal 46 illustrated on the left-hand side in FIG. 5 than for the current intensity signal illustrated on the right-hand side in FIG. 5. It is assumed here that, owing to the change from the current intensity level for the left-hand side current intensity signal 46 toward the current intensity level for the right-hand side current intensity signal 46, the detention effect 55 occurs, that is to say that the setpoint value 45 was too high to release the inlet valve in the desired manner as early as during the attenuation current 44 for the opening movement. In other words, on account of the current intensity of the attenuation current 44, the inlet valve 16 remains in the closed position Sc for too long and is then suddenly accelerated to the open position So where it stops at such a high speed that undesired operating noise is produced. FIG. 5 shows how this leads to a greater difference value D and a longer time period 50.

Figure 6:
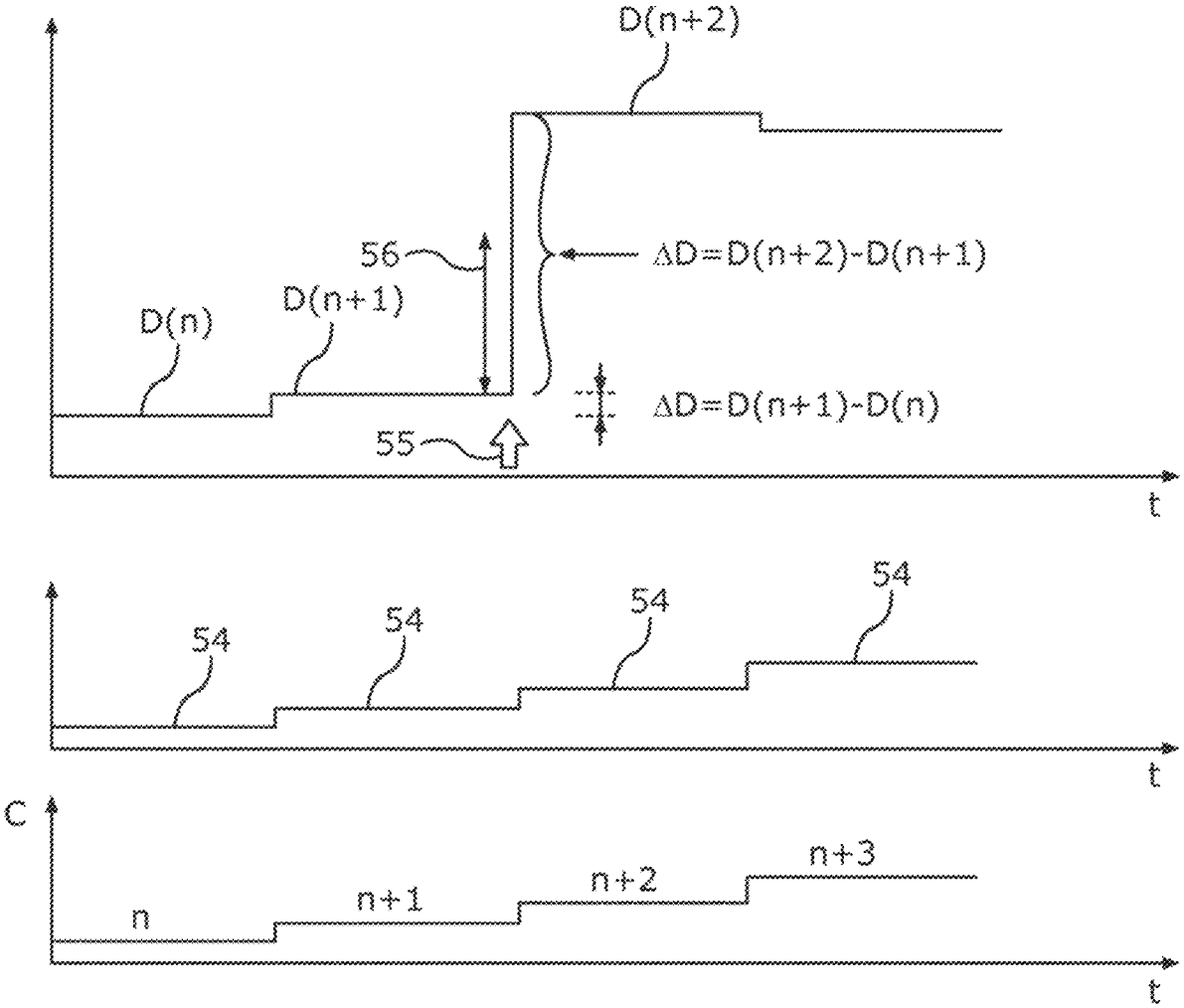
FIG. 6 shows graphs with schematic profiles of signals as can be ascertained by the control device for identifying a detention effect based on teachings of the present disclosure.

To this end, FIG. 6 illustrates how a current intensity level 54 for the attenuation current 44 can be set in each case as setpoint value 45 for individual pump cycles C in order to detect the detention effect 55. The pump cycles C are denoted by a counter n, n+1, n+2, n+3 here. The current intensity level 54 is set for each pump cycle C, wherein the current intensity levels 54 are successively larger. A different difference value D is correspondingly produced for each pump cycle C. A relative change ΔD in the difference values D of the successive current intensity levels 54 exceeds a threshold value 56 when the detention effect 55 occurs. This can be detected by the control device 17 by means of threshold value detection. The current intensity level 54 used immediately before the detention effect 55 occurs (this is n+1 in FIG. 6) can then be set as the optimum current intensity for the attenuation current 39.

Therefore, the current intensity is adjusted to the maximum possible current intensity level 54 for braking the inlet valve 16, without the detention effect 55 occurring. This calibration or setting can be automatically adjusted for each model of a high-pressure pump individually in every motor vehicle. Therefore, attenuation of noise can be individually optimized in every motor vehicle.

What is claimed is:

1. A method for adjusting an initial attenuation current for braking an injection valve in a high-pressure pump of a high-pressure injection system, the method comprising:

moving a piston with in a compression chamber of the high-pressure pump in successive pump cycles to a top dead center;

while the piston is moving toward the top dead center, closing the inlet valve using a control device applying a current to an electromagnet;

expelling the fluid from the compression chamber through an outlet valve;

while the piston is moving away from the top dead center, applying an attenuation current to the electromagnet using the control device, with the inlet valve still closed;

switching a source for the attenuation current off;

detecting an induction pulse resulting from an opening movement of the inlet valve by monitoring a current intensity signal of a subsequently decay in the attenuation current;

adjusting a current intensity value of the attenuation current over a plurality of pump cycles to a current intensity level;

checking for each current intensity level whether a time profile of the induction pulse satisfies a predetermined detention criterion; and when the detention criterion is satisfied, adjusting the current intensity level for future pump cycles to a lower current intensity level than that by which the detention criterion is satisfied.

2. The method as claimed in claim 1, wherein each successive current intensity level provides a higher current intensity value than the preceding current intensity level; and further comprising, when the detention criterion is satisfied, setting the current intensity value of the preceding current intensity level for the future pump cycles.

3. The method as claimed in claim 1, further comprising, after the source of the attenuation current is switched off, detecting a first inflection point and a second inflection point as respective induction pulses in the dropping current intensity signal of the attenuation current.

4. The method as claimed in claim 3, further comprising recording a difference value of a respective value of the current intensity signal at the second inflection point and at the first inflection point.

5. The method as claimed in claim 4, further comprising ascertaining the difference value of the induction pulse for each current intensity level; and wherein the detention criterion corresponds to a relative change in the difference value in the event of a change from one current intensity level to the next higher current intensity level is greater than a predetermined threshold value.

6. The method as claimed in claim 3, further comprising recording a time period which elapsing between the first inflection point and the second inflection point; and wherein the detention criterion comprises the time period exceeding a predetermined maximum value.

7. The method as claimed in claim 1, wherein a source of the attenuation current comprises a current intensity regulator and the current intensity level is set as a setpoint value in the current intensity regulator.

8. A control device for a high-pressure injection system of an internal combustion engine of a motor vehicle, the control device comprising:

a processor; and a memory storing a set of instructions, the set of instructions, when loaded and executed by the processor, causing the processor to:

move a piston within a compression chamber of the high-pressure pump in successive pump cycles to a top dead center;

while the piston is moving toward the top dead center, close the inlet valve using a control device applying a current to an electromagnet;

expel the fluid from the compression chamber through an outlet valve;

while the piston is moving away from the top dead center, apply an attenuation current to the electromagnet using the control device with the inlet valve still closed;

switch a source for the attenuation current off;

detect an induction pulse resulting from an opening movement of the inlet valve by monitoring a current intensity signal of a subsequently decay in the attenuation current;

adjust a current intensity value of the attenuation current over a plurality of pump cycles to a current intensity level;

check for each current intensity level whether a time profile of the induction pulse satisfies a predetermined detention criterion; and when the detention criterion is satisfied, adjust the current intensity level for future pump cycles to a lower current intensity level than that by which the detention criterion is satisfied.

9. A high-pressure injection system for a motor vehicle, the system comprising:

a high-pressure pump having a piston moving within a compression chamber;

a processor; and a memory storing a set of instructions, the set of instructions, when loaded and executed by the processor, causing the processor to:

move the piston within the compression chamber in successive pump cycles to a top dead center;

while the piston is moving toward the top dead center, close the inlet valve using a control device applying a current to an electromagnet;

expel the fluid from the compression chamber through an outlet valve;

while the piston is moving away from the top dead center, apply an attenuation current to the electromagnet using the control device with the inlet valve still closed;

switch a source for the attenuation current off;

detect an induction pulse resulting from an opening movement of the inlet valve by monitoring a current intensity signal of a subsequently decay in the attenuation current;

adjust a current intensity value of the attenuation current over a plurality of pump cycles to a current intensity level;

check for each current intensity level whether a time profile of the induction pulse satisfies a predetermined detention criterion; and when the detention criterion is satisfied, adjust the current intensity level for future pump cycles to a lower current intensity level than that by which the detention criterion is satisfied.

* * * * *